US007854534B2

(12) United States Patent
Liu

(10) Patent No.: US 7,854,534 B2
(45) Date of Patent: Dec. 21, 2010

(54) LED LAMP

(75) Inventor: You-Xue Liu, Shenzhen (CN)

(73) Assignees: Fu Zhun Precision Industry (Shen Zhen) Co., Ltd., Shenzhen, Guangdong Province (CN); Foxconn Technology Co., Ltd., Tucheng, Taipei County (TW)

( * ) Notice: Subject to any disclaimer, the term of this patent is extended or adjusted under 35 U.S.C. 154(b) by 259 days.

(21) Appl. No.: 12/257,402

(22) Filed: Oct. 24, 2008

(65) Prior Publication Data

US 2009/0323324 A1 Dec. 31, 2009

(30) Foreign Application Priority Data

Jun. 27, 2008 (CN) ..... 2008 1 0068079

(51) Int. Cl.
*F21V 29/00* (2006.01)

(52) U.S. Cl. ..... 362/294; 362/345; 362/373

(58) Field of Classification Search ..... 362/294, 362/345, 373, 580, 547, 126, 218, 264, 249.02, 362/800

See application file for complete search history.

(56) References Cited

U.S. PATENT DOCUMENTS

| | | | | |
|---|---|---|---|---|
| 7,434,959 | B1 * | 10/2008 | Wang | 362/294 |
| 7,607,802 | B2 * | 10/2009 | Kang et al. | 362/294 |
| 7,641,363 | B1 * | 1/2010 | Chang et al. | 362/294 |
| 7,654,702 | B1 * | 2/2010 | Ding et al. | 362/294 |
| 7,726,845 | B2 * | 6/2010 | Zheng et al. | 362/294 |
| 7,766,513 | B2 * | 8/2010 | Zhang et al. | 362/294 |

* cited by examiner

*Primary Examiner*—Bao Q Truong
(74) *Attorney, Agent, or Firm*—Frank R. Niranjan

(57) ABSTRACT

An LED lamp includes a housing defining an opening in a front face thereof, a heat sink received in the housing and a plurality of LED modules mounted on the heat sink. The housing has two parallel horizontal plates at lower and top ends thereof. The heat sink includes a V-shaped conductive plate placed on the lower horizontal plate of the housing and has two differently-sized portions with front faces thereof defining an obtuse included angle therebetween. The front faces face the opening of the housing. The LED modules are mounted on the front faces of the portions of the conductive plate of the heat sink.

20 Claims, 3 Drawing Sheets

LED LAMP

BACKGROUND OF THE INVENTION

1. Field of the Invention

The disclosure relates to an LED lamp for a lighting purpose, and more particularly to an improved LED lamp configured as a floor lamp for a street lighting purpose.

2. Description of Related Art

An LED lamp is a type of solid-state lighting that utilizes light-emitting diodes (LEDs) as a source of illumination. An LED is a device for transferring electricity to light by using a theory that, if a current is made to flow in a forward direction through a junction region comprising two different semiconductors, electrons and holes are coupled at the junction region to generate a light beam. The LED has an advantage that it is resistant to shock, and has an almost eternal lifetime under a specific condition; thus, the LED lamp is intended to be a cost-effective yet high quality replacement for incandescent and fluorescent lamps.

Known implementations of LED modules in an LED lamp make use of a plurality of individual LEDs to generate light that is sufficient and of satisfactory spatial distribution. The large number of LEDs leads to a more expensive module and one with greater power consumption. The greater power usage leads to greater heat output, which, if not adequately addressed at additional expense, impacts the LED lamp reliability.

A conventional LED lamp incorporates a heat dissipating configuration therein, which can dissipate heat generated by the LEDs timely. Thus, the conventional LED lamp can properly perform without overheating. However, to meet a demanding requirement of heat dissipation and provide a satisfactory illumination, this type of LED lamp at least has to consist of a heat sink, a cover and a connecting base, thereby complicating a structure of the LED lamp. As the complicated structure, the LED lamp usually has to be mounted in a predetermined way; for example, the LED lamp can only be held in position by a support of an upper end of a fixing rod whereby the LED lamp is used as a floor lamp. On the other hand, the LED lamp is suspended by a lower end of the fixing rod, whereby the LED lamp is used as a pendant lamp. However, either being supported or suspended by the fixing rod, the lamp is usually fixed high in the air for a purpose of street lighting; it is very inconvenient for repair, maintenance and installation of the lamp in such a high position.

What is needed, therefore, is an improved LED lamp assembly which can overcome the described limitations.

SUMMARY OF THE INVENTION

An LED lamp includes a housing defining an opening in a front face thereof, a heat sink received in the housing and a plurality of LED modules mounted on the heat sink. The housing has two parallel horizontal plates at lower and top ends thereof. The heat sink includes a V-shaped conductive plate placed on the lower horizontal plate of the housing. The V-shaped conductive plate has small and large portions with front faces thereof defining an obtuse included angle therebetween. The front faces face the opening of the housing. The LED modules are mounted on the front faces of the small and large portions of the conductive plate of the heat sink. The LED lamp is mounted to sit directly on a roadside of a road with the front face of the small portion being parallel to an edge of the road and facing perpendicularly to the road and the front face of the large portion facing slantwise to the road and facing a car approaching direction of the road.

Other advantages and novel features will become more apparent from the following detailed description of preferred embodiments when taken in conjunction with the accompanying drawings.

BRIEF DESCRIPTION OF THE DRAWINGS

Many aspects of the present embodiments can be better understood with reference to the following drawings. The components in the drawings are not necessarily drawn to scale, the emphasis instead being placed upon clearly illustrating the principles of the present embodiments. Moreover, in the drawings, like reference numerals designate corresponding parts throughout the several views.

DETAILED DESCRIPTION OF THE INVENTION

Figure 1:
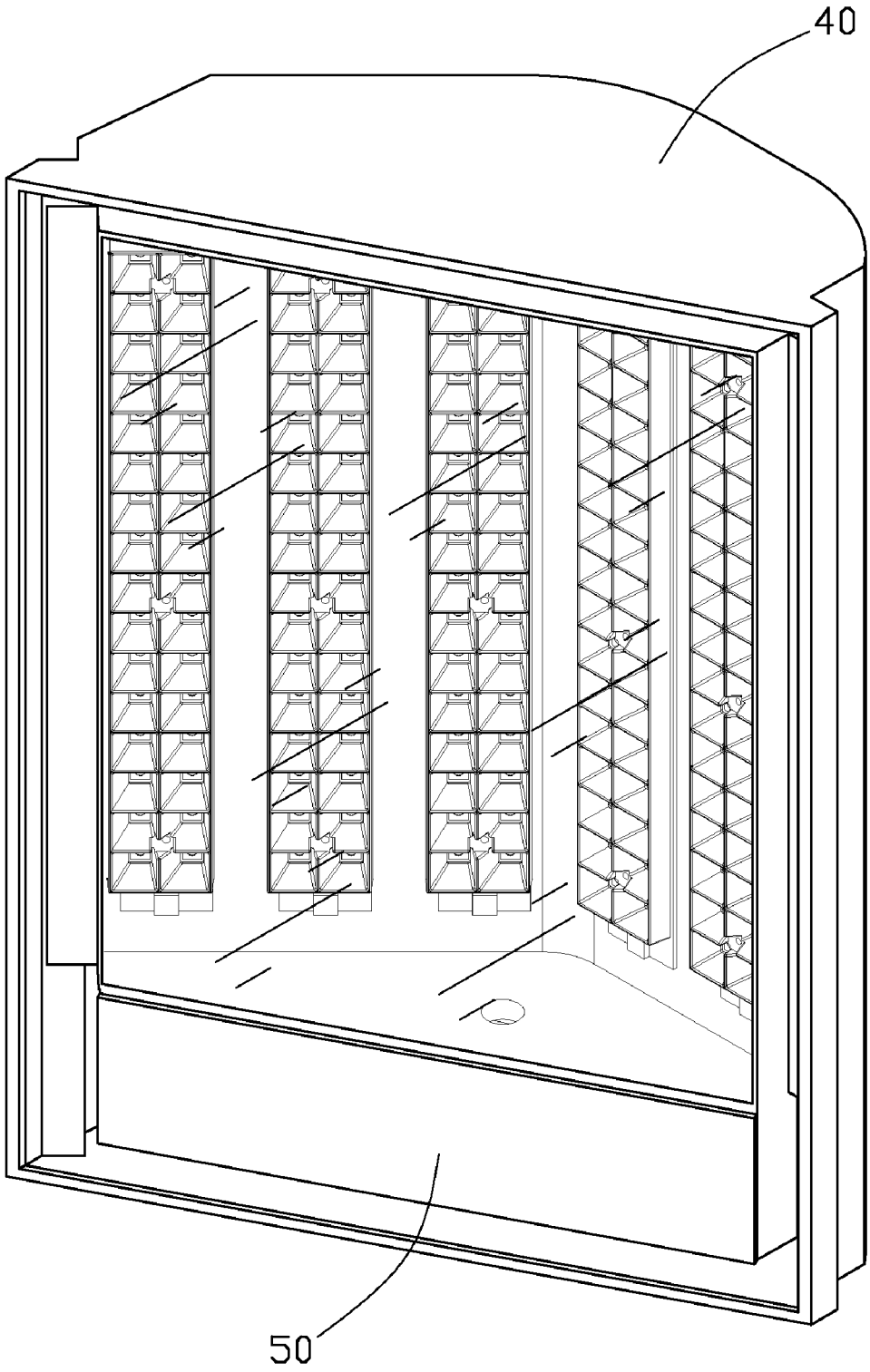
FIG. 1 is an isometric, assembled view of an LED lamp in accordance with a preferred embodiment of the present invention.
Figure 2:
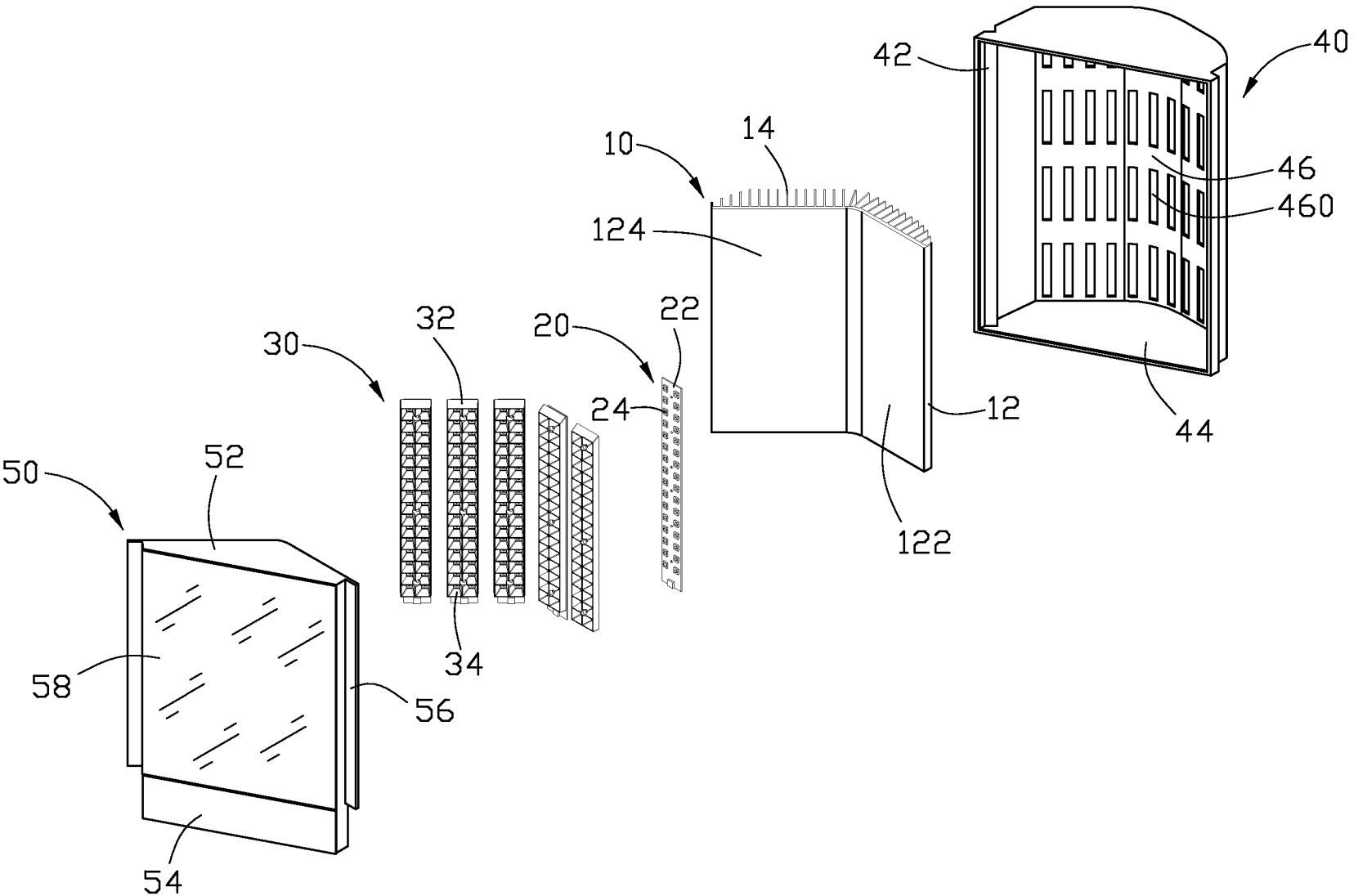
FIG. 2 is an exploded view of the LED lamp of FIG. 1.
Figure 3:
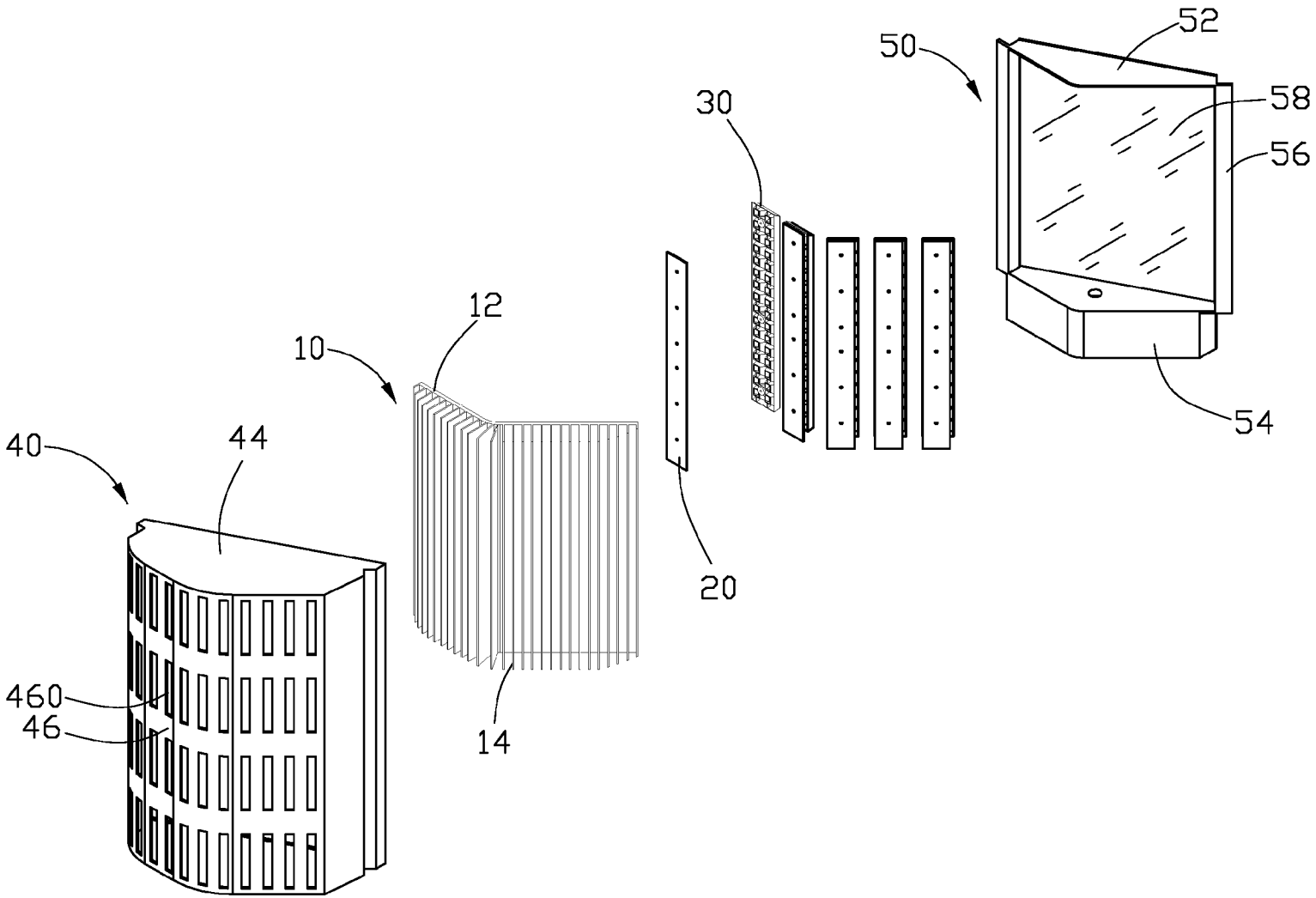
FIG. 3 is similar to FIG. 2, viewed from an opposite aspect.

Referring to FIGS. 1-3, an LED lamp in accordance with a preferred embodiment is illustrated. The LED lamp is configured to be directly mounted on a roadside of a road to lighten the road, whereby drivers in vehicles moving along the road can obtain a satisfactory and sufficient illumination of the road. The LED lamp is prism-shaped, vertically standing on the roadside and comprises a heat sink 10, a plurality of LED modules 20 fixed on a front side of the heat sink 10, a plurality of light-guiding modules 30 respectively mounted over the LED modules 20, a housing 40 receiving the heat sink 10 and the light-guiding and LED modules 30, 20 therein and a lamp cover 50 engaging with the housing 40 to enclose the heat sink 10 and the light-guiding and LED modules 30, 20.

The heat sink 10 is integrally formed from a material with high heat conductivity such as aluminum and copper and comprises a conductive plate 12 and a plurality of fins 14 extending backwardly from a rear side of the conductive plate 12. The conductive plate 12 consists of small and large rectangular portions 122, 124. The conductive plate 12 has a uniform thickness throughout its entirety and is bent backwardly into a V-shaped configuration. An obtuse included angle is defined between front faces of the small and large portions 122, 124. The front faces of the two portions 122, 124 cooperatively constitute a front face of the conductive plate 12. In use of the LED lamp, the front face of the large portion 124 slantwise faces an approaching car and the front face of small portion 122 perpendicularly face the road and is extended parallel to an edge of the road when the LED lamp is mounted on the roadside. The fins 14 are spaced from each other with a constant distance between two adjacent fins 14 and arranged perpendicularly on rear faces of the respective small and large portions 122, 124 of the conductive plate 12. The fins 14 on each portion 122 (124) are parallel to each other and two opposite lateral sides of the each portion 122 (124) of the conductive plate 12.

The LED modules 20 are evenly mounted on the front face of the conductive plate 12 and face toward the lamp cover 50. There are five LED modules 20 wherein three of them are mounted on the large portion 124 and the other two are mounted on the small portion 122. Each LED module 20 comprises an elongated circuit board 22 and two lines of LEDs 24 arranged side by side on the circuit board 22 along a length of the circuit board 22. The circuit boards 22 are evenly fixed on the front faces of the two portions 122, 124 of the conductive plate 12 and parallel to the two opposite lateral sides of each of the two portions 122, 124 of the conductive plate 12.

The light-guiding modules 30 each comprise an elongated supporting frame 32 and two lines of light guiding units 34 side by side formed in the supporting frame 32. The supporting frame 32 has a shape similar to that of the circuit board 22; thus, the supporting frame 32 can fitly cover the circuit board 22. The light guiding units 34 are respectively in alignment with the LEDs 24 and each is mounted around a corresponding one of the LEDs 24 to reflect light emitted by the corresponding one of the LEDs 24.

The housing 40 defines a rectangular opening 42 in a front face thereof, through which the heat sink 10 is placed thereinto. The housing 40 comprises two parallel horizontal plates 44 at top and bottom thereof and a back plate 46 interconnecting the horizontal plates 44. The back plate 46 is expanded backwardly from two opposite lateral sides of the housing 40, thereby cooperating with the horizontal plates 44 to defining a receiving space (not labeled) in rear of and in communication with the opening 42 to receive the heat sink 10 therein. A plurality of vents 460 are defined and evenly distributed in the back plate 46 for accelerating air ventilation through the fins 14 of the heat sink 10.

The lamp cover 50 is engagingly received in the opening 42 of the housing 40 to cover the front face of conductive plate 12 of the heat sink 10 received in the housing 40 and thus cooperate with the housing 40 to closely enclose the heat sink 10 with the LED and light-guiding modules 20, 30 in the LED lamp. The lamp cover 50 has a rectangular frame (not labeled), a top plate 52 extending backwardly from a top edge of the rectangular frame, a mounting box 54 coupled to a lower portion of the rectangular frame, two elongated engaging flanges 56 extending laterally from two opposite long lateral sides of the rectangular frame and a rectangular lens 58 mounted in the rectangular frame and covering the LED modules 20 mounted on the front face of the conductive plate 12 of the heat sink 10. The top plate 52 is triangular and has two bevel edges snugly attached to upper edges of the front faces of the small and large portions 122, 124 of the conductive plate 12 of the heat sink 10. The mounting box 54 is prism-shaped and has two inclined faces protruding backwardly and snugly attached to lower edges of the front faces of the small and large portions 122, 124 of the conductive plate 12 of the heat sink 10. The engaging flanges 56 at the two long lateral sides of the lamp cover 50 are respectively abutted against inner sidewalls (not labeled) of the housing 40 at the two lateral sides adjacent the opening 42 when the lamp cover 50 is engaged in the opening 42 of the housing 40 to hold the lamp cover 50 in position. The lens 58 is made of transparent plastic or glass and has a dimension similar to that of a projection of the heat sink 10 on the lens 58 for allowing light emitted by the LED modules 20 to travel completely through the lens 58.

In assembly of the LED lamp, the heat sink 10 is received in the housing 40 with the conductive plate 12 of the heat sink 10 perpendicularly placed on the lower horizontal plate 44 of the housing 40 and facing the opening 42 of the housing 40. The fins 14 extending backwardly from the rear face of the conductive plate 12 are perpendicular to the horizontal plates 44 of the housing 40 and located close to the back plate 46 of the housing 40. Since the two portions of the conductive plate 12 are angled from each other, the LED modules 20 mounted on the front faces of the two flat plate parts of the conductive plate 12 are respectively directed to two orientations to obtain a required illumination on the road.

In use of the LED lamp, the lower horizontal plate 44 of the housing 40 of the LED lamp is directly mounted on the roadside; thus, the LED lamp is securely mounted by the roadside with the lamp cover 50 facing the road to provide the road with illumination. The housing 40 and the lamp cover 50 engaging with the housing 40 can protect the LED lamp from sunlight, rainwater and accidental damages. Heat generated by the LED modules 20 in use can be timely adsorbed by the conductive plate 12 of the heat sink 10 and evenly distributed over the fins 14, and then dissipated into ambient through the vents 460 of the back plate 46 of the lamp cover 40.

It is believed that the present embodiments and their advantages will be understood from the foregoing description, and it will be apparent that various changes may be made thereto without departing from the spirit and scope of the invention or sacrificing all of its material advantages, the examples hereinbefore described merely being preferred or exemplary embodiments of the invention.

What is claimed is:

1. An LED lamp comprising:

a housing defining an opening in a front face thereof and comprising two parallel horizontal plates at lower and top ends thereof;

a heat sink received in the housing and comprising a V-shaped conductive plate placed on the lower horizontal plate of the housing and having two portions with front faces thereof defining an obtuse included angle therebetween, the front faces facing the opening; and a plurality of LED modules mounted on the front faces of the two portions of the conductive plate of the heat sink.

2. The LED lamp as claimed in claim 1, wherein the conductive plate of the heat sink has a rear face towards the housing and a plurality of fins extending backwardly from the rear face.

3. The LED lamp as claimed in claim 2, wherein the fins spaced from each other with a constant distance are located between the conductive plate and the housing and perpendicular to the horizontal parts of the housing.

4. The LED lamp as claimed in claim 1, wherein the housing comprises a back plate interconnecting the horizontal plates and expanding backwardly from two opposite lateral sides of the opening.

5. The LED lamp as claimed in claim 4, wherein a plurality of vents are defined and distributed all over the back plate of the housing.

6. The LED lamp as claimed in claim 1, wherein the LED modules each comprise an elongated circuit board fixed on the front faces of the two portions of the conductive plate of the heat sink and parallel to the two opposite lateral sides of each of the two portions of the conductive plate, and two lines of LEDs arranged side by side on the circuit board along a length of the circuit board.

7. The LED lamp as claimed in claim 1, further comprising a plurality of light-guiding modules respectively mounted over the LED modules and each having an elongated supporting frame covering a corresponding LED module and a plurality of light guiding units formed in the supporting frame and respectively in alignment with LEDs of the corresponding LED module.

8. The LED lamp as claimed in claim 1, further comprising a lamp cover received in the opening of the housing and cooperating with the housing to enclose the heat sink on which the LED modules are mounted therein, the lamp cover comprising a rectangular frame, a top plate extending backwardly towards the housing from a top edge of the rectangular frame, a mounting box coupled to a lower portion of the rectangular frame, two elongated engaging flanges extending laterally from two opposite lateral sides of the rectangular frame and a rectangular lens mounted in the rectangular frame and covering the LED modules mounted on the front faces of the portions of the conductive plate of the heat sink.

9. The LED lamp as claimed in claim 8, wherein the top plate is triangular and has two bevel edges snugly attached to upper edges of the front faces of the two portions of the conductive plate of the heat sink, and wherein the mounting box is prism-shaped and has two inclined faces protruding towards the housing and snugly attached to lower edges of the front faces of the two portions of the conductive plate of the heat sink.

10. The LED lamp as claimed in claim 9, wherein the engaging flanges at the two lateral sides of the lamp cover are respectively abutted against inner sidewalls of the housing at the two lateral sides of the opening, and the lens is made of transparent plastic or glass and has a dimension consistent with that of a projection of the heat sink on the lens for allowing light emitted by the LED modules to travel completely through the lens.

11. An LED lamp, comprising:

a housing defining an opening in a front face thereof and comprising two parallel horizontal plates at lower and top portions thereof and a back plate interconnecting the two parallel horizontal plates and expanding rearwards from two opposite lateral sides of the opening;

a heat sink received in the housing and comprising a conductive plate placed on the lower horizontal plate of the housing and having two portions with front faces thereof defining an included angle therebetween, the front faces facing the opening of the housing, and a plurality of fins extending from rear faces of the two portions of the conductive plate; and a plurality of LED modules mounted on the front faces of the conductive plate of the heat sink.

12. The LED lamp as claimed in claim 11, wherein the fins are spaced from each other with a constant distance and located between the conductive plate and the back plate of the housing and perpendicular to the horizontal plates of the housing.

13. The LED lamp as claimed in claim 12, wherein a plurality of vents are defined and distributed all over the back plate of the housing.

14. The LED lamp as claimed in claim 11, wherein the LED modules each comprise an elongated circuit board fixed on the front faces of the two portions of the conductive plate of the heat sink and parallel to the two opposite lateral sides of each of the two portions of the conductive plate of the heat sink, and two lines of LEDs arranged side by side on the circuit board along a length of the circuit board.

15. The LED lamp as claimed in claim 14, further comprising a plurality of light-guiding modules respectively mounted over the LED modules and each having an elongated supporting frame covering a corresponding LED module and a plurality of light guiding units formed in the supporting frame and respectively in alignment with the LEDs of the corresponding LED module.

16. The LED lamp as claimed in claim 11, further comprising a lamp cover received in the housing and cooperating with the housing to enclose the heat sink on which the LED modules are mounted, the lamp cover comprising a rectangular frame, a top plate extending towards the housing from a top edge of the rectangular frame, a mounting box coupled to a lower portion of the rectangular frame, two elongated engaging flanges extending laterally from two opposite lateral sides of the rectangular frame and a rectangular lens mounted in the rectangular frame and covering the LED modules mounted on the front face of the conductive plate of the heat sink.

17. The LED lamp assembly as claimed in claim 16, wherein the top plate is triangular and has two bevel edges snugly attached to upper edges of the front faces of the two portions of the conductive plate of the heat sink, and the mounting box is prism-shaped and has two inclined faces protruding backwardly and snugly attached to lower edges of the front faces of the two portions of the conductive plate of the heat sink.

18. The LED lamp as claimed in claim 17, wherein the engaging flanges at the two lateral sides of the lamp cover are respectively abutted against the housing at the two lateral sides of the opening, and the lens is made of transparent plastic or glass and has a dimension consistent with that of a projection of the heat sink over the lens for allowing light emitted by the LED modules to travel completely through the lens.

19. An LED lamp adapted for mounting directly on a roadside of a road having cars moving thereon to illuminate the road, the LED lamp comprising:

a housing defining an opening in a front face thereof and comprising two parallel horizontal plates at lower and top portions thereof and a back plate interconnecting the two parallel horizontal plates and expanding rearwards from two opposite lateral sides of the opening;

a heat sink received in the housing and comprising a conductive plate placed on the lower horizontal plate of the housing and having a large portion and a small portion with front faces thereof defining an included angle therebetween, the front faces facing the opening of the housing, and a plurality of fins extending from rear faces of the two portions of the conductive plate; and a plurality of LED modules mounted on the front faces of the conductive plate of the heat sink, wherein a number of the LED modules mounted on the large portion is more than that of the LED modules mounted on the small portion.

20. The LED lamp as claimed in claim 19, wherein the small portion is adapted to be parallel to an edge of the road and face perpendicularly to the road, and the large portion is adapted to face slantwise to the road and face an approaching direction of the cars, when the LED lamp is mounted on the roadside of the road.

* * * * *